US011346530B2

(12) United States Patent
Wenzel et al.

(10) Patent No.: US 11,346,530 B2
(45) **Date of Patent: *May 31, 2022**

(54) PORTABLE LIGHTING DEVICE WITH MOUNTING FEATURES

(71) Applicant: MILWAUKEE ELECTRIC TOOL CORPORATION, Brookfield, WI (US)

(72) Inventors: Duane W. Wenzel, Waukesha, WI (US); Brian Cornell, West Allis, WI (US); David Proeber, Milwaukee, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/174,567

(22) Filed: Feb. 12, 2021

(65) Prior Publication Data

US 2021/0164638 A1 Jun. 3, 2021

Related U.S. Application Data

(63) Continuation of application No. 16/595,724, filed on Oct. 8, 2019, now Pat. No. 10,920,966.

(60) Provisional application No. 62/743,402, filed on Oct. 9, 2018.

(51) Int. Cl.

| | |
|---|---|
| ***F21V 15/01*** | (2006.01) |
| ***F21V 23/00*** | (2015.01) |
| ***F21V 17/10*** | (2006.01) |

(52) U.S. Cl.

CPC ..... *F21V 15/01* (2013.01); *F21V 17/105* (2013.01); *F21V 23/001* (2013.01)

(58) Field of Classification Search

CPC ..... F21V 15/01; F21V 23/001; F21V 17/105; F21V 21/0965; F21V 21/0885; F21V 24/049; F21V 21/049; F21L 4/04; F21S 8/025; F21S 8/026

See application file for complete search history.

(56) References Cited

U.S. PATENT DOCUMENTS

| | | | | |
|---|---|---|---|---|
| 7,021,789 | B2 | 4/2006 | Dalton et al. | |
| 9,205,774 | B2 | 12/2015 | Kennemer et al. | |
| 9,739,467 | B1 * | 8/2017 | Lehman | F21V 23/0414 |
| 9,851,088 | B2 | 12/2017 | Harvey et al. | |
| 10,018,337 | B2 | 7/2018 | Dorman et al. | |
| 10,203,090 | B1 * | 2/2019 | Zhu | F21V 21/145 |
| 10,221,601 | B2 | 3/2019 | Eichelberger | |
| 10,281,125 | B2 | 5/2019 | Harvey | |
| 10,493,901 | B2 | 12/2019 | Schermerhorn et al. | |

(Continued)

*Primary Examiner* — Peggy A Neils

(74) *Attorney, Agent, or Firm* — Michael Best & Friedrich LLP

(57) ABSTRACT

A portable lighting device includes a light source, a body supporting the light source, the body including a first aperture, a second aperture, and a base with a bottom surface opposite the light source. The first and second apertures are configured to receive an electrical cable such that the electrical cable extends through both the first and second apertures. The portable lighting device also includes a mounting assembly coupled to the base and including a movable tab. The tab is movable relative to the base between a stored position and a deployed position, and the tab is configured to at least partially support the portable lighting device when the tab is in the deployed position.

20 Claims, 6 Drawing Sheets

(56) References Cited

U.S. PATENT DOCUMENTS

| | | | | |
|---|---|---|---|---|
| 10,920,966 | B2 * | 2/2021 | Wenzel | F21V 15/01 |
| 2013/0155662 | A1 | 6/2013 | Goschl | |
| 2017/0003009 | A1 | 1/2017 | McIntyre et al. | |
| 2018/0087729 | A1 | 3/2018 | Garvin | |
| 2019/0285257 | A1 | 9/2019 | Gall et al. | |
| 2020/0032988 | A1 | 1/2020 | Schubert | |

* cited by examiner

PORTABLE LIGHTING DEVICE WITH MOUNTING FEATURES

CROSS-REFERENCE TO RELATED APPLICATIONS

This application is a continuation of U.S. patent application Ser. No. 16/595,724, filed Oct. 8, 2019, issued as U.S. Pat. No. 10,920,966 on Feb. 16, 2021, which claims priority to U.S. Provisional Patent Application No. 62/743,402, filed on Oct. 9, 2018, the entire content of each of which is incorporated herein by reference.

BACKGROUND

The present invention relates to lighting devices, and more particularly to portable lighting devices.

SUMMARY

The present disclosure provides, in one aspect, a portable lighting device including a light source, a body supporting the light source, the body including a base having a bottom surface opposite the light source, and a mounting assembly coupled to the base, the mounting assembly including a movable tab. The tab is movable relative to the base between a stored position in which the tab is positioned adjacent the bottom surface and a deployed position in which the tab extends outwardly from the bottom surface. The tab is configured to at least partially support the portable lighting device when the tab is in the deployed position.

The present disclosure provides, in another aspect, a portable lighting device configured to be coupled to an electrical junction box. The portable lighting device includes a light source, a body supporting the light source, the body including a base having a bottom surface opposite the light source, and a mounting assembly coupled to the base, the mounting assembly including a magnetic member. The magnetic member is movable relative to the base between a stored position and a deployed position, and the magnetic member is engageable with the electrical junction box when the magnetic member is in the deployed position to magnetically couple the portable lighting device to the electrical junction box.

The present disclosure provides, in another aspect, a method of lighting a space with a portable lighting device including a light source, a base, and a plurality of tabs pivotally coupled to the base. The method includes inserting at least a portion of the base into an electrical box and moving the plurality of tabs from a stored position to a deployed position to engage the plurality of tabs with an interior of the electrical box. The engagement between the plurality of tabs and the interior of the electrical box couples the portable lighting device to the electrical box. The method also includes connecting an electrical cable to the portable lighting device to power the light source.

Other features and aspects of the disclosure will become apparent by consideration of the following detailed description and accompanying drawings.

DETAILED DESCRIPTION

Before any embodiments of the disclosure are explained in detail, it is to be understood that the disclosure is not limited in its application to the details of construction and the arrangement of components set forth in the following description or illustrated in the accompanying drawings. The disclosure is capable of other embodiments and of being practiced or of being carried out in various ways. Also, it is to be understood that the phraseology and terminology used herein is for the purpose of description and should not be regarded as limiting.

FIGS. 1A-5B illustrate a portable lighting device (or "light") 10 for providing illumination to a workspace or room. In some embodiments, the light 10 may be mounted to a wall, stud, ceiling, or alternative support surfaces using features discussed in greater detail below. In some embodiments, the light 10 may be electrically connected to existing electrical junctions and/or cabling in order to provide power to the light 10. The illustrated light 10 may be particularly advantageous in temporary use applications, such as to provide lighting at a jobsite before final lighting devices are installed.

Figure 1A:
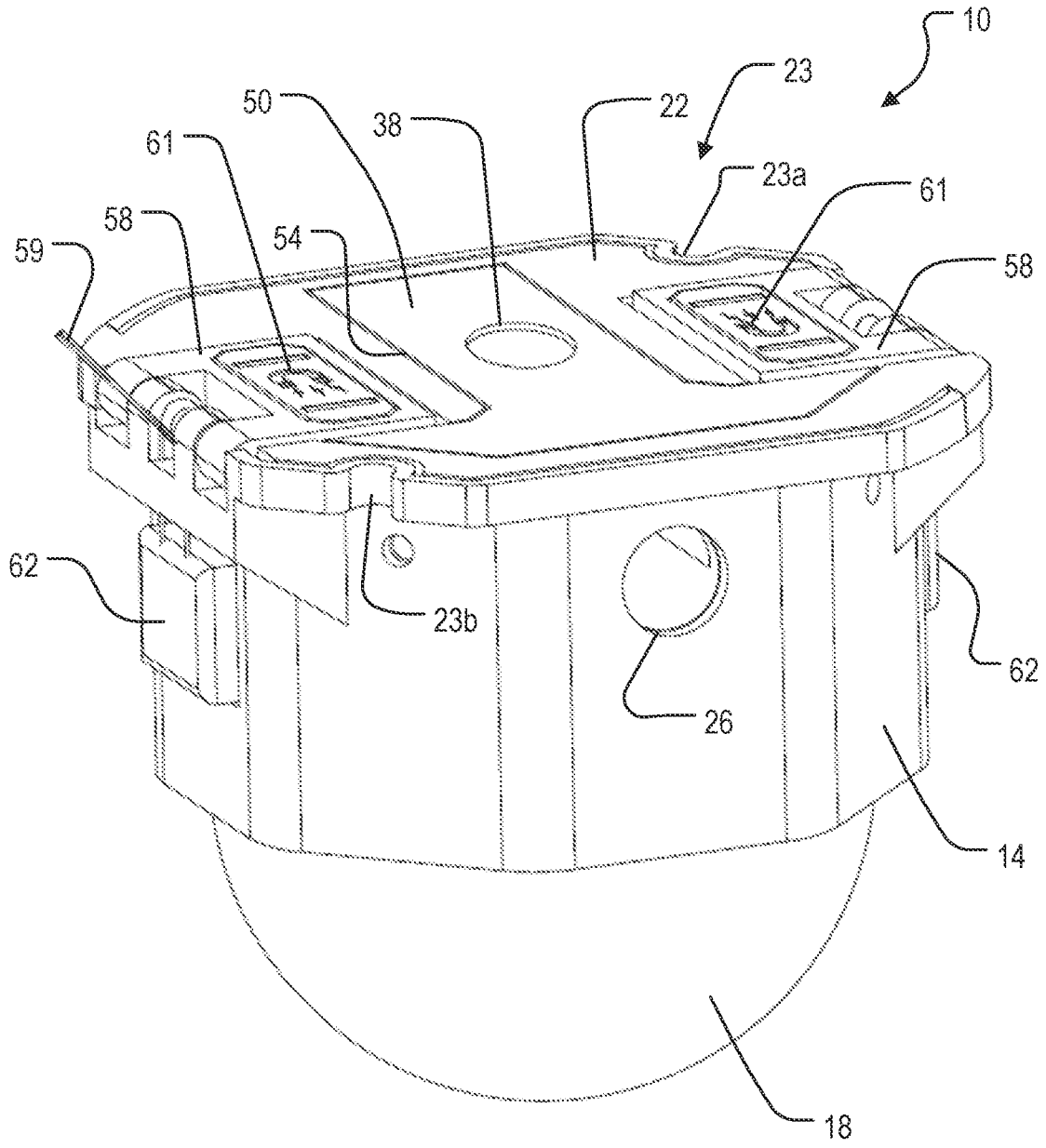
FIG. 1A is a perspective view of a portable lighting device embodying aspects of the present disclosure.

With reference to FIG. 1A, the illustrated light 10 includes a generally octagonal body 14 with a first end coupled to a transparent or translucent cover 18 and a second end opposite the first end. In the illustrated embodiment, body 14 includes a base 22 at the second end. In some embodiments, the base 22 and/or the body 14 are configured (i.e. sized and shaped) to be insertable into a standard electrical junction box.

Figure 2:
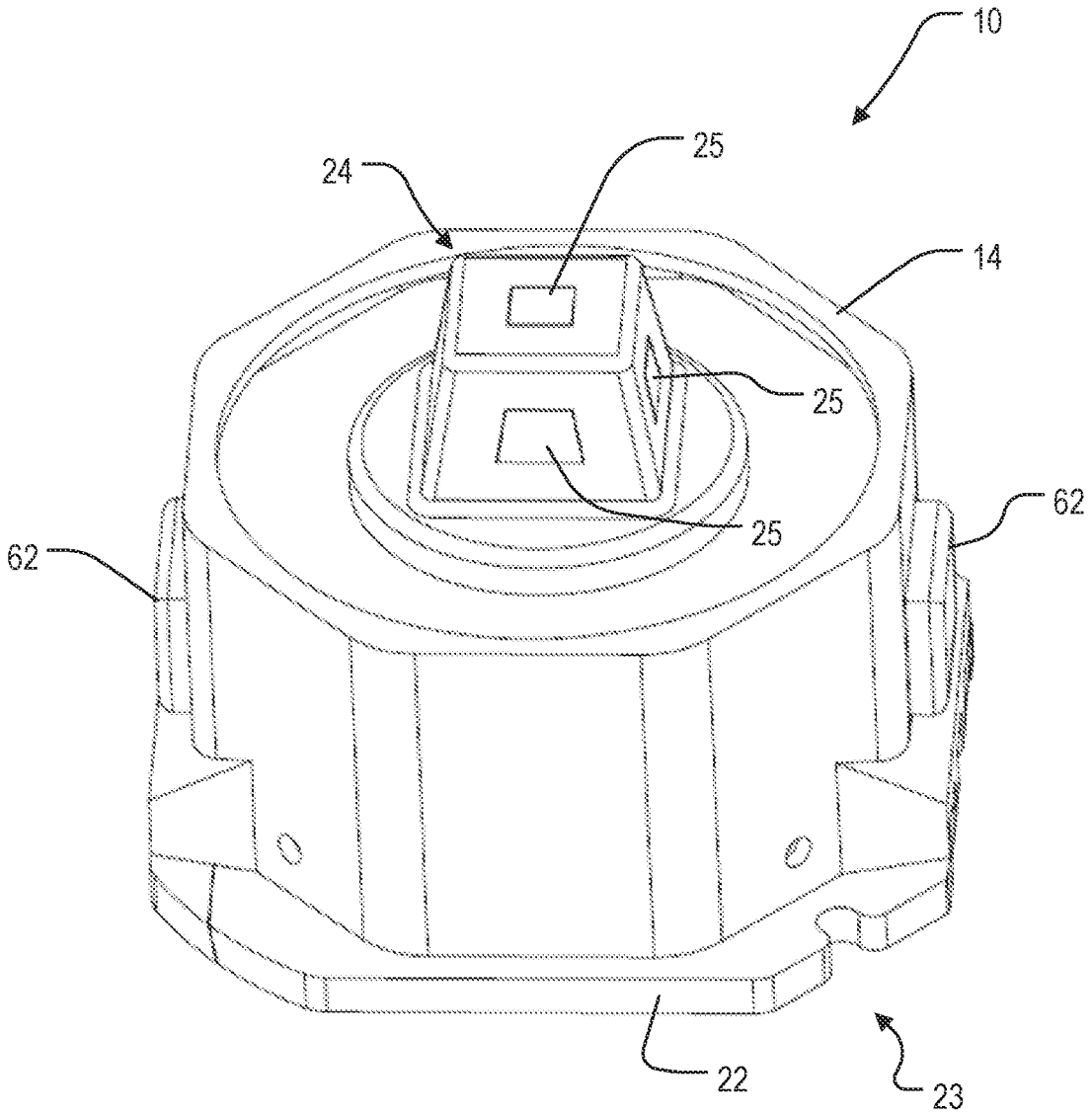
FIG. 2 is a perspective view of the portable lighting device of FIG. 1, with a cover removed.

Referring to FIG. 2, a light source 24, which in the illustrated embodiment includes a plurality of LEDs 25, is positioned under the cover 18 and is illuminated when provided power via a power source (FIG. 2). In other embodiments, the light source 24 may include a single LED 25, or the light source 24 may include other lighting elements, such as one or more fluorescent or incandescent lighting elements. The illustrated cover 18 is dome shaped and may act as a lens or a diffuser in some embodiments. The cover 18 may be made of any suitably translucent or transparent material. In some embodiments, the cover 18 is made of an impact-resistant material such as polycarbonate to protect the light source 24.

The illustrated base 22 has a substantially flat bottom surface opposite the cover 18. The term "bottom" and other directional terms herein are used for convenience and should not be regarded as limiting. That is, it should be understood that the bottom surface defined by the base 22 may be a top surface, a back surface, etc., depending on the particular orientation of the light 10. The base 22 includes a first mount assembly 23 for securing the light 10 to a surface. In the illustrated embodiment, the first mount assembly 23 includes a pair of slots 23*a*, 23*b* in the outer periphery of the base 22. The illustrated slots 23*a*, 23*b* are located on opposite corners of the base 22. In other embodiments, the slots 23*a*, 23*b* may be located elsewhere on the outer periphery of the base 22. Additionally or alternatively, the first mount assembly 23 may include fewer or more slots 23*a*, 23*b*. The slots 23*a*, 23*b* are configured to receive fasteners, such as screws or nails, to secure the light 10 to the surface. In some embodiments, the first mount assembly 23 may additionally or alternatively include one or more keyholes to mount the light 10 on a fastener protruding from the surface.

With continued reference to FIG. 1A, the body 14 includes a first aperture 26 that extends through a lateral side of the body 14 between the first and second ends. A second aperture 38 extends through the base 22. As such, in some embodiments, the second aperture 38 is transverse to the first aperture 26. The apertures 26, 38 may provide access points for cables to provide power to the light 10.

Figure 1B:
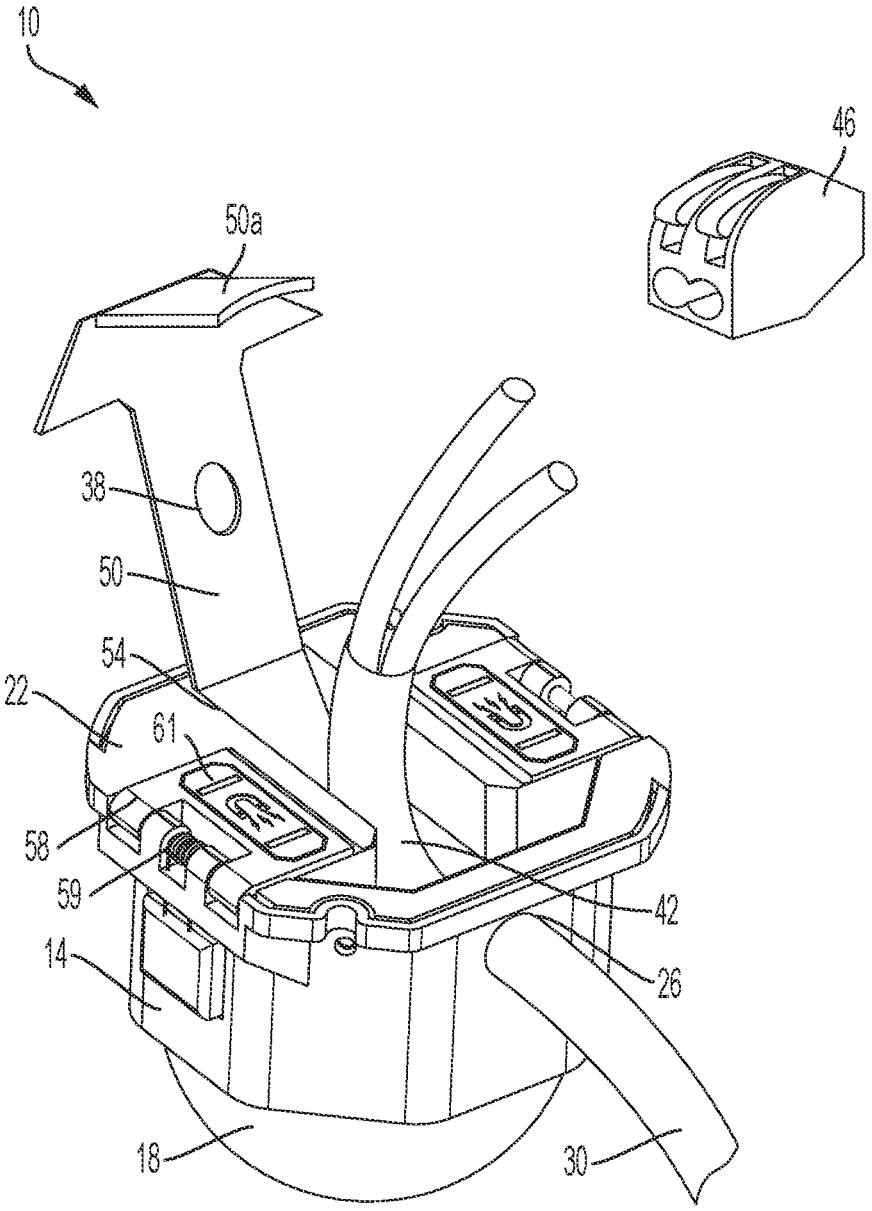
FIG. 1B illustrates the portable lighting device of FIG. 1 receiving a cable.

For example, with reference to FIG. 1B, the light 10 may be configured to receive power from electrical cabling having a first cable portion 30 and a second cable portion 42. The electrical cabling may be typical residential or commercial electrical cabling (e.g., ROMEX cabling). In some embodiments, the electrical cabling may pass through the light 10 (e.g., via the apertures 26, 38), without discontinuities in the cabling. That is, the first cable portion 30 and the second cable portion 42 may both be portions of a single continuous cable. In other embodiments, the first cable portion 30 and the second cable portion 42 may be different cables, each having an end coupled to the light 10.

In some embodiments, the light 10 may be coupled in series (i.e. daisy-chained) to other lights 10 or other electrical components/devices. In such embodiments, the first cable portion 30 may extend through the first opening 26 to provide power to the light 10, and the second cable portion 42 may extend through the second opening 38 and provide pass-through power from the light 10. The second cable portion 42 may be coupled to a connector 46 (e.g., a WAGO connector), which may facilitate in cable splicing, cable connecting, etc. to downstream devices. That is, the connector 46 includes an output port (not shown), which allows for another device (e.g., a second light, etc.) to be plugged into the light 10 via the connector 46, such that multiple devices may be daisy-chained together. In other embodiments, the second cable portion 42 may provide power to the light 10, and the first cable portion 30 may provide pass-through power from the light 10. In alternate embodiments, the light 10 may additionally or alternatively be configured to receive power from a different power source, such as a battery.

The illustrated base 22 includes a movable bracket 50 for securing the cable portions 30, 42 within the base 22. Specifically, the bracket 50 is pivotable between a first or open position in which the bracket 50 disengages from an elongate slot 54 in the base 22 and extends away from the base 22 (FIG. 1B) and a second or closed position (FIG. 1A) in which the bracket 50 is received within the slot 54 such that the bracket 50 is flush with the bottom side of the base 22. In other embodiments, the bracket 50 may move in other manners relative to the base 22 (e.g. linearly slide relative to the base 22, completely decouple from the base 22, etc.). The slot 54 is shaped to match the shape of the bracket 50 and provide a snug fit when the bracket 50 is in the second position. When the bracket 50 is in the second position, the bracket 50 encloses the internal components of the light 10 within the body 14 and may provide a clamping force on the cable portions 30, 42. For example, in the illustrated embodiment, a tongue portion 50*a* of the bracket may press down on one or both of the cable portions 30, 42 such that if the cable portions 30, 42 are pulled, terminals of the light 10 connected to the cables 30, 42 are not damaged. The bracket 50 additionally includes the second aperture 38 to allow the second cable portion 42 to extend out of the base 22 when the bracket 50 is in the second position.

In some embodiments, the bracket 50 may also facilitate mounting the light 10. For example, the tongue portion 50*a* of the bracket 50 may act as a rafter hook to facilitate hanging the light 10 from a rafter when the bracket 50 is in the first position (FIG. 1B). In some embodiments, the second aperture 38 may also receive, a nail, screw, or other projection to mount the light 10.

Figure 3:
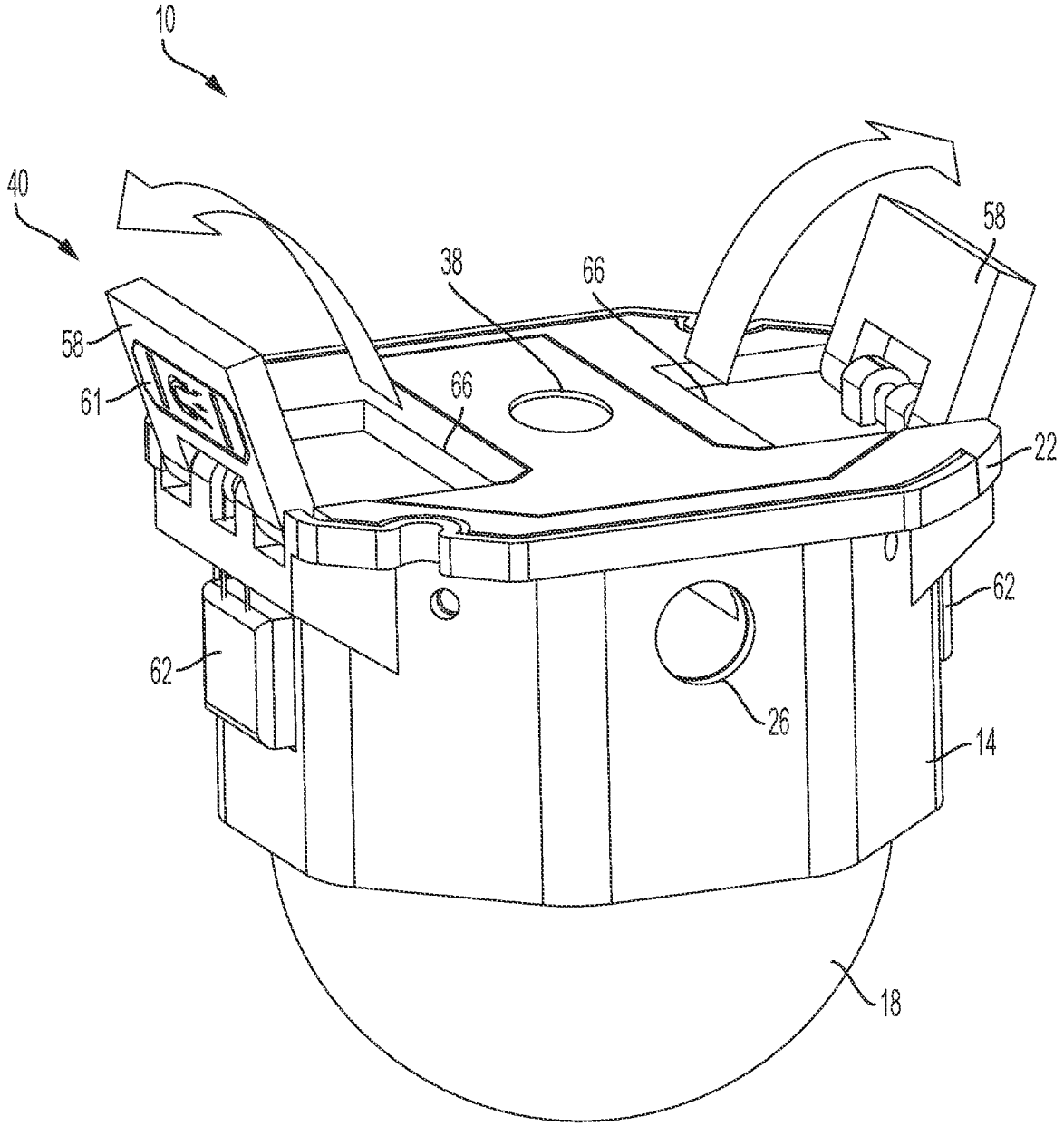
FIG. 3 is a perspective view of the portable lighting device of FIG. 1, illustrating a mounting feature of the lighting device moved to a deployed position.

With reference to FIGS. 1A and 3, the illustrated light 10 includes a second mounting assembly 40 on the base 22. The second mounting assembly 40 includes a pair of tabs 58 that are movable between an initial or stored position (FIG. 1A) and a deployed position (FIG. 3). In the illustrated embodiment, the tabs 58 are pivotally coupled to the base 22 such that the tabs 58 are pivotable relative to the base 22 between the stored position and the deployed position. In some embodiments, the tabs 58 may pivot from the stored position toward the deployed position in opposite directions. In some embodiments, each tab 58 may pivot about 90 degrees from the stored position to the deployed position. In some embodiments, each tab 58 may pivot between 90 degrees and 120 degrees from the stored position to the deployed position. In other embodiments, the tabs 58 may be coupled to the base 22 in other ways for movement (e.g., sliding movement, etc.) between the stored position and the deployed position. In yet other embodiments, the second mounting assembly 40 may include a different number of tabs 58, such as four tabs 58 equally circumferentially spaced about the base 22. In still other embodiments, the base 22 may have other shapes (e.g., triangular, hexagonal, etc.) and the second mounting assembly 40 may have a corresponding number of tabs 58 (e.g., three tabs, six tabs, etc.).

In the illustrated embodiment, the tabs 58 are biased toward the deployed position by respective springs 59 (an end of one of the springs 59 is shown in FIG. 1A for illustration purposes; however the springs 59 may be disposed at least partially within the base 22). In the illustrated embodiment, the springs 59 are torsion springs, but may be other types of springs. The tabs 58 may be latched in the stored position by a suitable latching mechanism (not shown). The second mounting assembly 40 may further include an actuator 62 to release the latching mechanism, thereby allowing the tabs 58 to move from the stored position to the deployed position under the influence of the springs 59. In the illustrated embodiment, the second mounting assembly 40 includes two actuators 62—one associated with each tab 58. The actuators 62 in the illustrated embodiment are constructed as push-buttons positioned on opposite sides of the body 14. In other embodiments, other types of actuators 62 may be provided, and the actuators 62 may be positioned elsewhere on the light 10. In yet other embodiments, a single actuator may be associated with both tabs 58.

In the illustrated embodiment, the tabs 58 may include one or more magnets 61 (e.g., permanent magnets) that may be embedded into the tab 58 or affixed to the tab 58 in any suitable manner. The magnets 61 are sufficiently strong to support the weight of the light 10 when the magnets 61 are placed into contact with a ferromagnetic surface. In other embodiments, that tabs 58 may additionally or alternatively include a high-friction or gripping material, such as an elastomeric material, so that the tabs 58 may support the light 10 via frictional engagement with a receptacle (e.g., an electrical box), for example.

Referring to FIG. 3, the tabs 58 in the illustrated embodiment are received within recesses 66 formed in the base 22 when the tabs 58 are in the stored position. In the illustrated embodiment, an outer surface of each magnet 61 is substantially flush with an outer surface of the associated tab 58. When the tabs 58 are in the stored position (FIG. 1A), the magnets 61 may extend parallel to the bottom surface of the base 22 and/or flush with the bottom surface of the base 22. When the tabs 58 are in the deployed position (FIG. 3), the magnets 61 may extend generally transverse to the base 22.

Figure 4A:
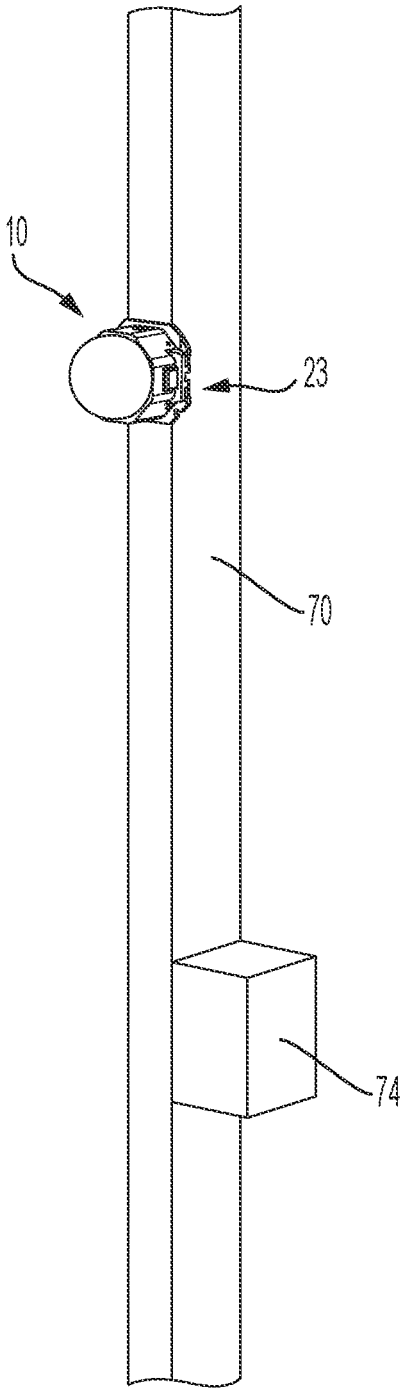
FIG. 4A illustrates the portable lighting device of FIG. 1 mounted to a stud.
Figure 4B:
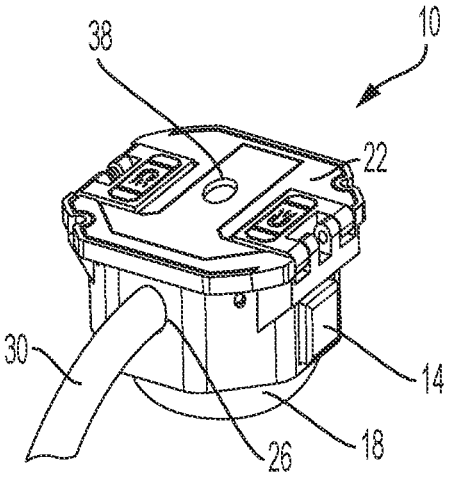
FIG. 4B illustrates the portable lighting device of FIG. 1 connected to a cable.

The illustrated light 10 may advantageously be mounted in a variety of different ways to facilitate placement in jobsite locations. For example, FIG. 4A illustrates the light 10 mounted to a stud 70 via the first mounting assembly 23. When the light 10 is mounted to a surface via the first mounting assembly 23, the tabs 58 of the second mounting assembly 40 may remain in the stored position to provide the light 10 with a compact footprint and to allow the bottom surface of the light 10 to be positioned adjacent and/or flush against the surface. The light 10 may be wired directly to an electrical box 74, such as a standard junction box, electrical outlet box, switch box, or the like. In such embodiments, the first cable portion 30 may be an electrical cable serving the electrical box 74 (FIG. 4B). As such, the light 10 may be conveniently mounted and powered with typical "roughed in" framing and electrical components that are present on jobsites.

Figure 5A:
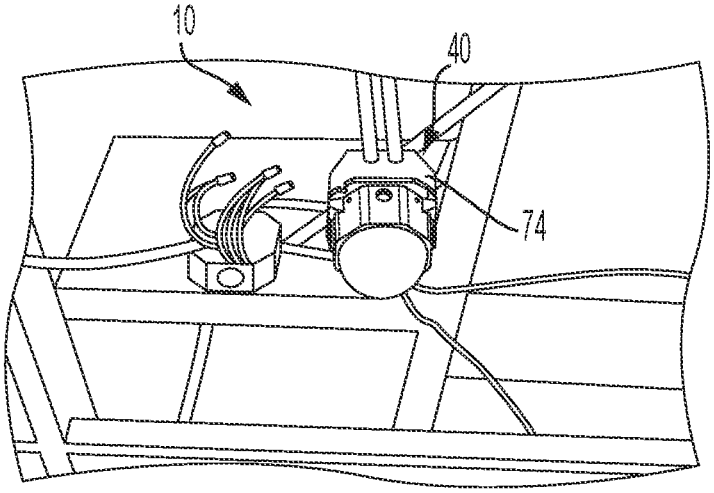
FIG. 5A illustrates the portable lighting device of FIG. 1 mounted to a junction box.
Figure 5B:
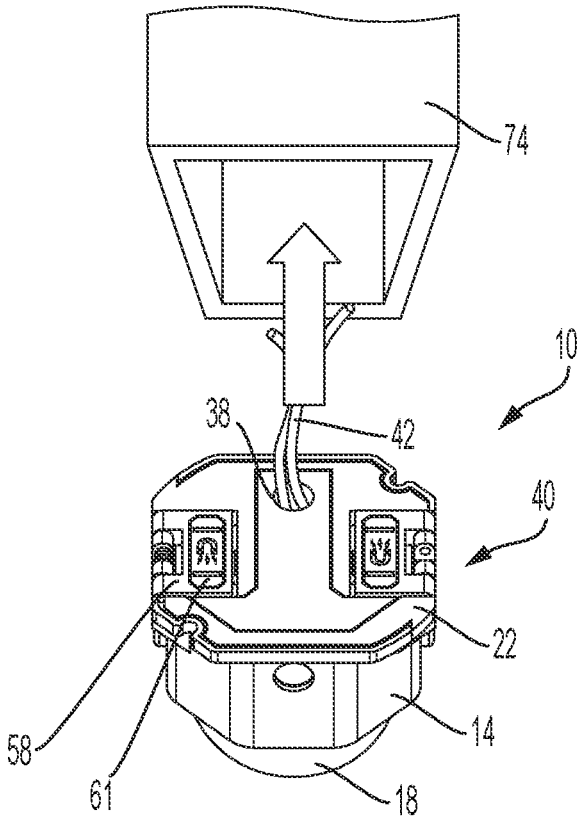
FIG. 5B illustrates the portable lighting device of FIG. 1 configured for insertion into an electrical box.

As another example, with reference to FIGS. 5A-5B, the light 10 may be mounted in an electrical box 74 (e.g., a standard ceiling junction box) or other receptacle. In such embodiments, the light 10 may be secured directly into the electrical box 74 via the second mounting assembly 40. More specifically, a user may at least partially insert the base 22 of the light 10 into the electrical box 74 with the tabs 58 in the stored position. The user may then depress the actuators 62, causing the tabs 58 to pivot outwardly and engage the interior sides of the electrical box 74. The engagement between the tabs 58 and the interior sides of the electrical box 74 secures the light 10 within the box 74 via magnetic and/or friction forces, without requiring the use of fasteners. The second aperture 38 extending through the base 22 allows access for the second cable portion 42, which may be an electrical cable serving the electrical box 74 (FIG. 5B).

Various features of the invention are set forth in the following claims.

What is claimed is:

1. A portable lighting device comprising:

a light source;

a body supporting the light source, the body including a first aperture, a second aperture, and a base with a bottom surface opposite the light source, the first and second apertures configured to receive an electrical cable such that the electrical cable extends through both the first and second apertures; and a mounting assembly coupled to the base, the mounting assembly including a movable tab, wherein the tab is movable relative to the base between a stored position and a deployed position, and wherein the tab is configured to at least partially support the portable lighting device when the tab is in the deployed position.

2. The portable lighting device of claim 1, further comprising a bracket pivotally coupled to the base for movement relative to the base between an open position and a closed position.

3. The portable lighting device of claim 2, wherein the first aperture extends through a side of the body, and wherein the second aperture extends through the bracket.

4. The portable lighting device of claim 2, wherein the bracket includes a tongue portion configured to extend into the body when the bracket is in the closed position.

5. The portable lighting device of claim 4, wherein the tongue portion is configured to engage the electrical cable when the bracket is in the closed position.

6. The portable lighting device of claim 1, wherein the tab includes a permanent magnet.

7. The portable lighting device of claim 1, wherein the tab is biased toward the deployed position by a spring.

8. The portable lighting device of claim 7, wherein the mounting assembly includes an actuator configured to release the tab for movement toward the deployed position under an influence of the spring.

9. The portable lighting device of claim 8, wherein the actuator includes a pushbutton.

10. The portable lighting device of claim 1, wherein the tab is a first tab, wherein the mounting assembly further includes a second tab pivotally coupled to the base.

11. The portable lighting device of claim 1, wherein the body is configured to be at least partially inserted into an electrical junction box.

12. A portable lighting device comprising:

a light source;

a body supporting the light source, the body including a base having a bottom surface opposite the light source;

a mounting assembly coupled to the base, the mounting assembly including a tab movable relative to the base between a stored position and a deployed position, wherein the mounting assembly is configured to at least partially support the portable lighting device when the tab is in the deployed position; and a bracket coupled to the base and including a tongue portion, the bracket movable relative to the base between an open position in which the bracket extends from the bottom surface of the base and a closed position in which the tongue is received within the body, wherein the tongue portion forms a hook configured to at least partially support the portable lighting device when the bracket is in the open position.

13. The portable lighting device of claim 12, wherein the body includes a first aperture, and wherein the bracket includes a second aperture oriented transverse to the first aperture when the bracket is in the closed position.

14. The portable lighting device of claim 12, wherein the body has an octagonal shape.

15. The portable lighting device of claim 12, further comprising a dome shaped cover coupled to the body and enclosing the light source.

16. The portable lighting device of claim 12, wherein the tab includes a permanent magnet.

17. A portable lighting device configured to be at least partially inserted into an electrical box, the portable lighting device comprising:

a light source;

a body supporting the light source, the body including a base having a bottom surface opposite the light source; and a plurality of tabs movably coupled to the base, wherein the plurality of tabs is movable relative to the base between a stored position and a deployed position, wherein the plurality of tabs is engageable with an interior of the electrical box when the plurality of tabs is in the deployed position to couple the portable lighting device to the electrical box, wherein the plurality of tabs is biased toward the deployed position by respective springs.

18. The portable lighting device of claim 17, wherein each of the plurality of tabs includes a permanent magnet, and wherein the engagement between the plurality of tabs and the interior of the electrical box magnetically couples the portable lighting device to the electrical box.

19. The portable lighting device of claim 17, further comprising a dome shaped cover coupled to the body and enclosing the light source.

20. The portable lighting device of claim 17, wherein the base is configured to be inserted into the electrical box when the plurality of tabs is in the stored position, and wherein the plurality of tabs is movable from the stored position toward the deployed position while the base is positioned within the electrical box.

* * * * *